US012331625B2

(12) United States Patent
Ji et al.

(10) Patent No.: US 12,331,625 B2
(45) Date of Patent: Jun. 17, 2025

(54) TURBINE FRACTURING APPARATUS AND TURBINE FRACTURING WELL SITE

(71) Applicant: YANTAI JEREH PETROLEUM EQUIPMENT & TECHNOLOGIES CO., LTD., Shandong (CN)

(72) Inventors: Xiaolei Ji, Shandong (CN); Rikui Zhang, Shandong (CN); Peng Zhang, Shandong (CN); Jifeng Zhong, Shandong (CN); Chunqiang Lan, Shandong (CN); Yipeng Wu, Shandong (CN); Xincheng Li, Shandong (CN)

(73) Assignee: Yantai Jereh Petroleum Equipment & Technologies Co., Ltd., Yantai (CN)

( * ) Notice: Subject to any disclaimer, the term of this patent is extended or adjusted under 35 U.S.C. 154(b) by 138 days.

(21) Appl. No.: 17/836,196

(22) Filed: Jun. 9, 2022

(65) Prior Publication Data

US 2023/0151723 A1 May 18, 2023

Related U.S. Application Data

(63) Continuation of application No. PCT/CN2022/071607, filed on Jan. 12, 2022.

(30) Foreign Application Priority Data

Nov. 18, 2021 (CN) ..... 202111368299.2

(51) Int. Cl.
*E21B 43/26* (2006.01)
*F01D 15/08* (2006.01)
*F04B 23/06* (2006.01)

(52) U.S. Cl.
CPC ..... *E21B 43/2607* (2020.05); *F01D 15/08* (2013.01); *F04B 23/06* (2013.01)

(58) Field of Classification Search
CPC ..... E21B 43/2607; F04B 23/06; F01D 15/08
See application file for complete search history.

(56) References Cited

U.S. PATENT DOCUMENTS 9,062,546 B2 * 6/2015 Chandler ..... F24H 1/06
11,174,716 B1 * 11/2021 Yeung ..... F04B 17/03
(Continued)

FOREIGN PATENT DOCUMENTS

CN 102602323 A 7/2012
CN 202935216 U * 5/2013
(Continued)

OTHER PUBLICATIONS

International Search Report and Written Opinion mailed Jun. 21, 2022 for International Application No. PCT/CN2022/071607.

*Primary Examiner* — Christopher S Bobish
(74) *Attorney, Agent, or Firm* — Crowell & Moring LLP

(57) ABSTRACT

An example turbine fracturing apparatus and an example turbine fracturing well site are disclosed. The turbine fracturing apparatus may include a turbine engine, configured to provide power; a deceleration device, having an input end and a plurality of output ends, the input end being connected with the turbine engine; a plurality of plunger pumps, connected with the plurality of output ends, respectively, each of the plurality of plunger pumps being configured to intake low-pressure fluid and discharge high-pressure fluid; and an auxiliary power unit, configured to provide auxiliary power to at least one of the turbine engine, the deceleration device, or each of the plurality of plunger pumps. The auxiliary power unit, the turbine engine, and the deceleration device may be sequentially arranged.

11 Claims, 8 Drawing Sheets

(56) References Cited

U.S. PATENT DOCUMENTS

| | | | | |
|---|---|---|---|---|
| 11,408,262 | B2 * | 8/2022 | Reckels | E21B 43/2607 |
| 11,408,263 | B2 * | 8/2022 | Yeung | F04B 47/02 |
| 11,795,799 | B2 * | 10/2023 | Wilson | F04B 17/03 |
| 11,852,000 | B2 * | 12/2023 | Crowe | F02C 7/36 |
| 2011/0164999 | A1 | 7/2011 | Meek | |
| 2016/0177945 | A1 * | 6/2016 | Byrne | F04B 1/0404 184/6 |
| 2017/0234308 | A1 * | 8/2017 | Buckley | F04B 53/22 417/53 |
| 2018/0283281 | A1 * | 10/2018 | Veilleux, Jr. | F02C 7/36 |
| 2019/0338762 | A1 * | 11/2019 | Curry | F04D 29/605 |
| 2020/0040878 | A1 * | 2/2020 | Morris | F04B 23/06 |
| 2021/0156241 | A1 * | 5/2021 | Cook | F04B 23/06 |
| 2024/0026868 | A1 * | 1/2024 | Morris | F04B 23/06 |

FOREIGN PATENT DOCUMENTS

| | | | |
|---|---|---|---|
| CN | 107237617 | A | 10/2017 |
| CN | 107816341 | A | 3/2018 |
| CN | 111237158 | A | 6/2020 |
| CN | 112983382 | A | 6/2021 |
| CN | 113323834 | A | 8/2021 |

* cited by examiner

TURBINE FRACTURING APPARATUS AND TURBINE FRACTURING WELL SITE

CROSS-REFERENCE TO RELATED APPLICATIONS

For all purposes, this patent application claims the benefit of priority to the Chinese Patent Application No. 202111368299.2 filed on Nov. 18, 2021, and is a continuation application of and claims the benefit of priority to International Application No. PCT/CN2022/071607 filed on Jan. 12, 2022 which is also based on and claims the benefit of priority to Chinese Patent Application No. 202111368299.2 filed on Nov. 18, 2021. The above-identified priority applications are herein incorporated by reference in their entireties.

TECHNICAL FIELD

The embodiments of the present disclosure relate to a turbine fracturing apparatus and turbine fracturing well site.

BACKGROUND

There are two main driving mechanisms for fracturing apparatus in oil and gas-field fracturing operation sites.

The first driving mechanisms is to use a diesel engine to drive the fracturing operation. For example, in this driving mechanisms, the diesel engine is connected with a gearbox to drive a fracturing pump to operate through a transmission shaft. In other words, the power source is the diesel engine, the transmission device includes the gearbox and the transmission shaft, and the actuator is a plunger pump.

The second driving mechanism is via electric power. For example, in this driving mechanism, an electric motor is connected with a transmission shaft or a coupling to drive the plunger pump to operate. The power source thereof thus includes the electric motor. The transmission device includes the transmission shaft or the coupling, and the actuator is a plunger pump.

SUMMARY

The embodiments of the present disclosure provide a turbine fracturing apparatus and a turbine fracturing well site to increase the utilization rate of unit operating area of the well site.

The embodiments of the present disclosure provide a turbine fracturing apparatus, including: a turbine engine, configured to provide power; a deceleration device, having an input end and a plurality of output ends, the input end being connected with the turbine engine; a plurality of plunger pumps, connected with the plurality of output ends, respectively, each of the plurality of plunger pumps being configured to suck low-pressure fluid and discharge high-pressure fluid; and an auxiliary power unit, configured to provide auxiliary power to at least one selected from the group consisting of the turbine engine, the deceleration device, and each of the plurality of plunger pumps; the auxiliary power unit, the turbine engine, and the deceleration device are sequentially arranged.

According to the turbine fracturing apparatus provided by an embodiment of the present disclosure, the plurality of plunger pumps may be arranged at a same side of the deceleration device.

According to the turbine fracturing apparatus provided by an embodiment of the present disclosure, the deceleration device includes a long edge and a short edge, and the plurality of plunger pumps are arranged at a side of the deceleration device along the long edge of the deceleration device.

According to the turbine fracturing apparatus provided by an embodiment of the present disclosure, the turbine engine is arranged at a side of the deceleration device along the short edge of the deceleration device.

According to the turbine fracturing apparatus provided by an embodiment of the present disclosure, the turbine engine is arranged at a side of the deceleration device opposite to the side of the deceleration device where the plurality of plunger pumps may be provided.

According to the turbine fracturing apparatus provided by an embodiment of the present disclosure, the deceleration device includes an input shaft and a plurality of output shafts, the turbine engine is connected with the input end of the deceleration device through the input shaft, and the plurality of output shafts are connected with the plurality of output ends of the deceleration device, respectively.

According to the turbine fracturing apparatus provided by an embodiment of the present disclosure, the plurality of plunger pumps may be arranged at both sides of the deceleration device, respectively.

According to the turbine fracturing apparatus provided by an embodiment of the present disclosure, the turbine engine is located above one of the plurality of plunger pumps.

According to the turbine fracturing apparatus provided by an embodiment of the present disclosure, the plurality of plunger pumps may include two plunger pumps, and the two plunger pumps are connected with two ends of a same output shaft of the deceleration device, respectively.

According to the turbine fracturing apparatus provided by an embodiment of the present disclosure, the auxiliary power unit and the deceleration device are arranged at both sides of the turbine engine, respectively.

According to the turbine fracturing apparatus provided by an embodiment of the present disclosure, the auxiliary power unit includes an auxiliary motor, and the turbine engine or the deceleration device is provided with a power take-off port to drive the auxiliary motor.

According to the turbine fracturing apparatus provided by an embodiment of the present disclosure, the auxiliary power unit includes at least one selected from the group consisting of a lubricating unit, a cooling unit, an air supplying unit, and a ventilating unit, and the auxiliary motor includes at least one selected from the group consisting of a lubricating motor, a cooling motor, an air supplying motor, and a ventilating motor.

According to the turbine fracturing apparatus provided by an embodiment of the present disclosure, the turbine fracturing apparatus further includes a clutch, one clutch is provided between each of the plurality of plunger pumps and the deceleration device.

According to the turbine fracturing apparatus provided by an embodiment of the present disclosure, the turbine fracturing apparatus further includes a connecting structure, each of the plurality of plunger pumps is connected with the deceleration device through one connecting structure, and the clutch is closer to the deceleration device than the connecting structure.

According to the turbine fracturing apparatus provided by an embodiment of the present disclosure, the turbine fracturing apparatus further includes a connecting structure, each of the plurality of plunger pumps is connected with the deceleration device through a connecting structure.

According to the turbine fracturing apparatus provided by an embodiment of the present disclosure, the turbine fracturing apparatus further includes a base, the base includes a long edge and a short edge, and the turbine engine and the deceleration device are sequentially arranged along an extending direction of the long edge of the base.

According to the turbine fracturing apparatus provided by an embodiment of the present disclosure, the auxiliary power unit, the turbine engine, and the deceleration device are sequentially arranged along the extending direction of the long edge of the base.

According to the turbine fracturing apparatus provided by an embodiment of the present disclosure, the plurality of plunger pumps may be in contact with the base, and are sequentially arranged along the long edge or short edge of the base.

According to the turbine fracturing apparatus provided by an embodiment of the present disclosure, an interval is provided between the turbine engine and the plurality of plunger pumps in a direction perpendicular to a main surface of the base.

The embodiments of the present disclosure further provide a turbine fracturing well site, including any one of the turbine fracturing apparatuses as described above.

According to the turbine fracturing well site provided by an embodiment of the present disclosure, the turbine fracturing well site further includes a manifold skid, wherein each of the plurality of plunger pumps includes a discharge end, the discharge end of each of the plurality of plunger pumps is configured to discharge the high-pressure fluid, and discharge ends of the plurality of plunger pumps are arranged towards the manifold skid.

BRIEF DESCRIPTION OF THE DRAWINGS

In order to illustrate the technical solution of the embodiments of the present disclosure, the drawings of the embodiments are briefly described below. The drawings are only related to some example embodiments of the present disclosure and thus are not construed as imposing any limitation to the present disclosure.

DETAILED DESCRIPTION

Figure 1:
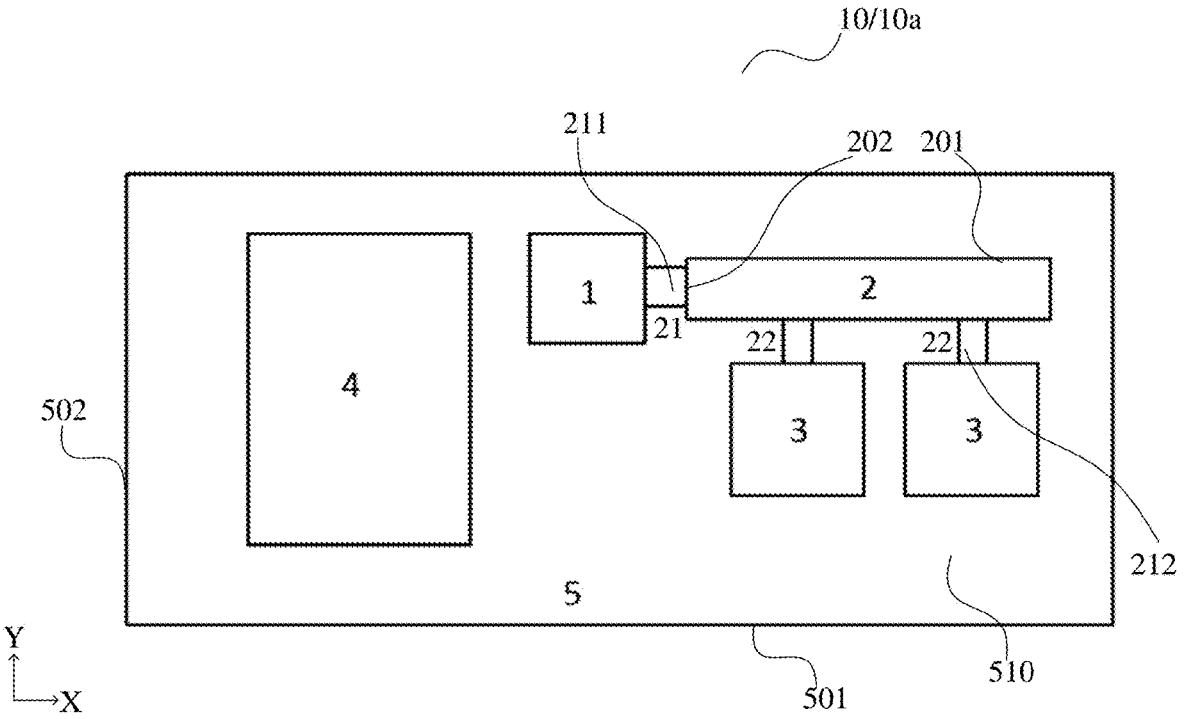
FIG. 1-FIG. 6 are layout diagrams of an example turbine fracturing apparatus provided by embodiments of the present disclosure.

In order to explain the objectives, technical details and advantages of the embodiments of the present disclosure, the technical solutions of the embodiment are described below in connection with the drawings related to the embodiments of the present disclosure. The described embodiments are merely examples and do not encompass all of the embodiments of the present disclosure. Based on the described embodiments herein, those having ordinary skill in the art can obtain other embodiment(s), without any inventive work. Those embodiments should be considered as being within the scope of the present disclosure.

Unless otherwise defined, all the technical and scientific terms used herein have the same meanings as commonly understood by one of ordinary skill in the art to which the present disclosure belongs. The terms "first," "second," etc., which are used in the present disclosure, are not intended to indicate any sequence, amount or importance, but distinguish various components. Also, the terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the described object is changed, the relative position relationship may be changed accordingly.

In terms of the driving manner (or scheme) by using a diesel engine, the configuration mode has the following disadvantages: it will produce exhaust gas and noise pollution exceeding, e.g., 105 dBA; the engine is bulky and cannot realize high-power operation; and the initial cost and the later maintenance cost are high and uneconomical.

In terms of electric drive fracturing, the electric drive fracturing itself has many advantages and can reduce noise pollution and meet the requirements of high-power operation. However, it needs arrangement of electric power supply apparatuses in advance, which is the prerequisite for the implementation of electrically driven fracturing operation. The electric power supply problem of the fracturing well site is not easy to solve. Either the power grid capacity of the well site is too small to supply the whole fracturing set, or there is no power grid at the well site at all. Therefore, electric generators are usually used to provide electricity in typical electric drive fracturing sites, and the most economical fuel for power generation is natural gas. The use of natural gas, however requires operators to rent or purchase gas-fired generator set. For a fracturing well site without power grid, the power of the gas-fired generator set needs to reach at least 30 MW, which may require a considerable investment for the operators to purchase such a large power gas-fired generator set. Moreover, in the actual well-site operation process, the whole electric drive fracturing set may be paralyzed as a result of a failure of the gas-fired generator set, which will seriously affect the operation quality and may even lead to operation accidents.

Usually, the turbine fracturing apparatus includes a single turbine engine and a single plunger pump, and the utilization rate of unit operating area of the well site is not high. A failure of the plunger pump will lead to the shutdown of the whole apparatus. The existing apparatus is noisy and will cause noise pollution to the environment. The turbine engine of the existing apparatus is only configured to drives the plunger pump, and the utilization of the turbine engine is not high.

FIG. 1-FIG. 6 are layout diagrams of example turbine fracturing apparatus provided by various embodiments of the present disclosure. As illustrated in FIG. 1-FIG. 6, the turbine fracturing apparatus 10 may include a turbine engine 1, a deceleration device 2, a plunger pump 3, and an auxiliary power unit 4. FIG. 1-FIG. 6 illustrate example turbine fracturing apparatuses 10*a*, 10*b*, 10*c*, 10*d*, 10*e* and 10*f*, respectively.

As illustrated in FIG. 1-FIG. 6, the turbine engine 1 may be configured to provide power. The deceleration device 2 has an input end 21 and a plurality of output ends 22, and the input end 21 may be connected with the turbine engine 1. A plurality of plunger pumps 3 may be connected with the plurality of output ends 22. The plunger pump 3 may be configured to draw/suck/intake low-pressure fluid and discharge high-pressure fluid. The auxiliary power unit 4 may be configured to provide auxiliary power to at least one of the turbine engine 1, the deceleration device 2, and the plunger pumps 3, or the auxiliary power unit 4. The turbine engine 1 and the deceleration device 2 may be sequentially arranged. The turbine engine 1 may be configured to drive the plunger pumps.

The example turbine fracturing apparatus provided by the embodiment of the present disclosure adopts a single turbine engine and multiple pumps. That is, one turbine engine may be configured to drive a plurality of plunger pumps, thus improving the utilization rate of unit operating area of the well site. The output power of a single apparatus (turbine fracturing set) is large, which can replace at least two ordinary diesel fracturing trucks. The displacement of fracturing fluid by the plunger pump can also be more stable under such a configuration.

When two plunger pumps are used, a structure of single turbine engine and double pumps is formed. That is, one turbine engine operates to drive two plunger pumps. The embodiments of the present disclosure are described with reference to the case where one turbine engine drives two plunger pumps, merely by way of example.

The fracturing apparatus having a single turbine engine and multiple pumps (e.g., single turbine engine and double pumps) provided by the embodiment of the present disclosure is used to increase the operating power of the fracturing apparatus and to increase the utilization efficiency per unit area of the well site. Moreover, the noise level of the apparatus is lowered by using a single turbine engine, which reduces the noise pollution to the environment.

As illustrated in FIG. 1-FIG. 6, according to the turbine fracturing apparatus provided by the embodiment of the present disclosure, the turbine fracturing apparatus may further include a base 5. The base may include a long edge 501 and a short edge 502, and the turbine engine 1 and the deceleration device 2 may be sequentially arranged along the extending direction of the long edge 501 of the base 5. The length of the long edge 501 may be greater than that of the short edge 502. In some example implementations, two long edges 501 may be arranged opposite to each other, and two short edges 502 may be arranged opposite to each other.

For example, as illustrated in FIG. 1-FIG. 2 and FIG. 4-FIG. 5, the long edge 501 may extend in the direction X and the short edge 502 may extend in the direction Y.

As illustrated in FIG. 1-FIG. 6, according to the turbine fracturing apparatus provided by the embodiment of the present disclosure, two plunger pumps 3 may be in contact with the base 5, and may be sequentially arranged along the long edge 501 or the short edge 502 of the base 5. The figures further illustrate a plan view of the base with a shape of rectangle, but the shape of the base is not limited to a rectangle, and other suitable shapes can be adopted as needed.

As illustrated in the examples of FIG. 1-FIG. 6, in order to facilitate the layout of each component, the auxiliary power unit 4, the turbine engine 1, and the deceleration device 2 may be sequentially arranged along the extending direction of the long edge 501 of the base 5.

As illustrated in the examples of FIG. 1-FIG. 6, the turbine engine 1, the deceleration device 2, the plunger pumps and the like may be disposed/placed on the base 5. For example, the base 5 can be skid-mounted, vehicle-mounted or semi-trailer.

As illustrated in the examples of FIG. 1-FIG. 6, the turbine engine 1 may be connected with the input end 21 of the deceleration device 2. The deceleration device 2 may be configured with at least a plurality of output ends 22, and the plunger pumps 3 are connected with the output ends 22 of the deceleration device 2. In some example implementations, the plunger pumps 3 and the deceleration device 2 can also be connected by using a transmission device.

As illustrated in FIG. 1, FIG. 2, FIG. 4 and FIG. 5, according to the example turbine fracturing apparatus provided by the embodiment of the present disclosure, in order to facilitate the layout of the turbine fracturing apparatus and to balance the weight distribution of the plunger pumps, two plunger pumps 3 may be arranged at the same side of the deceleration device 2. The plunger pumps 3 may be arranged at the same side of the deceleration device 2, which is beneficial to the arrangement of other components.

Figure 2:
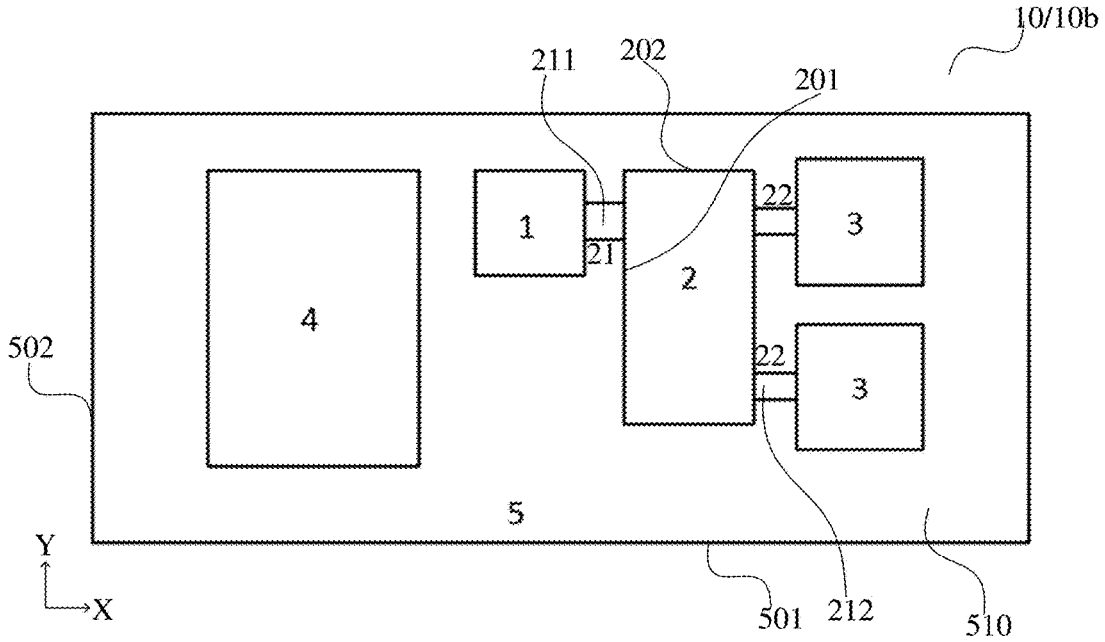

As illustrated in FIG. 1-FIG. 6, the deceleration device 2 may include a long edge 201 and a short edge 202, and the length of the long edge 201 may be greater than that of the short edge 202. As illustrated in FIG. 1-FIG. 6, two long edges 201 may be arranged opposite to each other, and two short edges 202 may be arranged opposite to each other. FIG. 1 and FIG. 2 illustrate the deceleration device 2 with a shape of rectangle. However, the plan view of the deceleration device 2 is not limited to a rectangle, and other suitable shapes can be adopted as needed. For example, the long edge 201 and the short edge 202 of the deceleration device 2 may be the long edge and the short edge of the bottom surface of the deceleration device 2. However, they may not be so limited. For example, the long edge 201 and the short edge 202 of the deceleration device 2 can also be the long edge and the short edge of the orthographic projection of the deceleration device 2 on the base 5. For example, the long edge 201 and the short edge 202 of the deceleration device 2 can also be the long edge and the short edge of part of the deceleration device 2 that is in contact with the base 5. For example, the long edge 201 of the deceleration device 2 may correspond to a first side surface of the deceleration device 2, whereas the short edge 202 of the deceleration device 2 may correspond to a second side surface of the deceleration device 2. Two first side surfaces of the deceleration device 2 may be arranged opposite to each other, and two second side surfaces of the deceleration device 2 may be arranged opposite to each other. The first side surface and the second side surface of the deceleration device 2 may be adjacent to each other.

Figure 4:
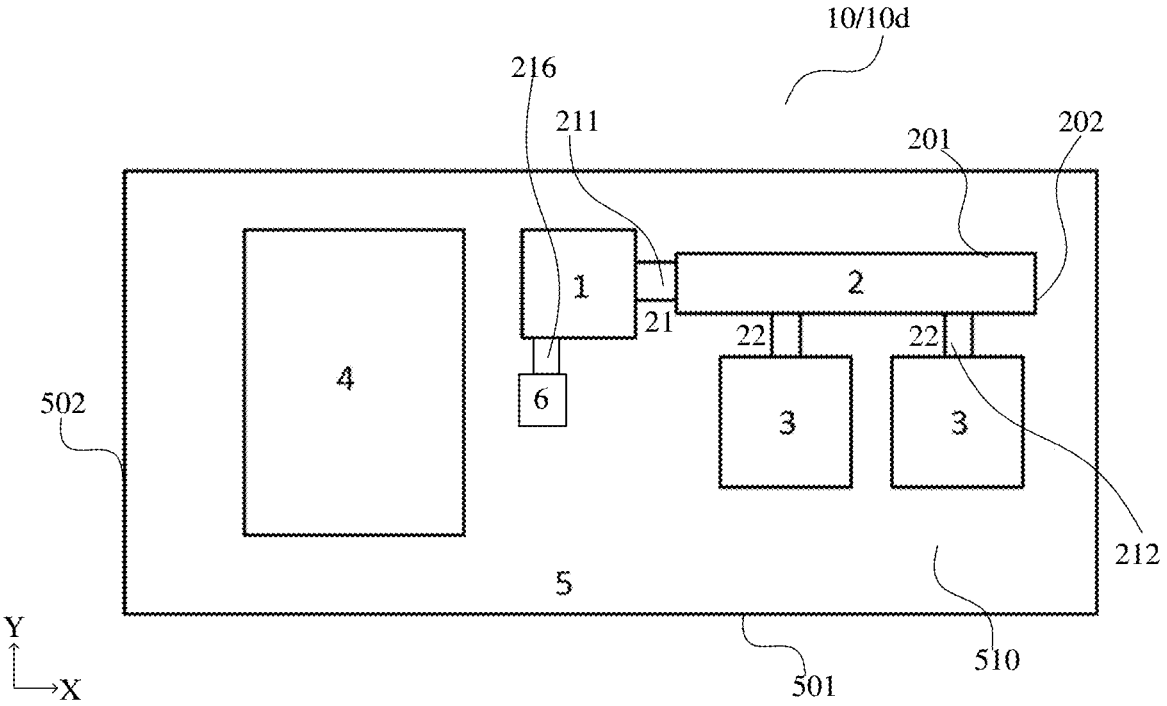

As illustrated in FIG. 1 and FIG. 4, according to the example turbine fracturing apparatus provided by the embodiment of the present disclosure, in order to facilitate the layout of the turbine fracturing apparatus and to balance the weight distribution of the plunger pumps, two plunger pumps 3 may be arranged at the side of the deceleration device 2 along the long edge 201 of the deceleration device 2.

As illustrated in FIG. 1 and FIG. 4, according to the example turbine fracturing apparatus provided by the embodiment of the present disclosure, in order to make the turbine engine and the plunger pumps be arranged at different sides of the deceleration device 2, the turbine engine 1 may be arranged at the side of the deceleration device 2 along the short edge 202 of the deceleration device 2.

Figure 5:
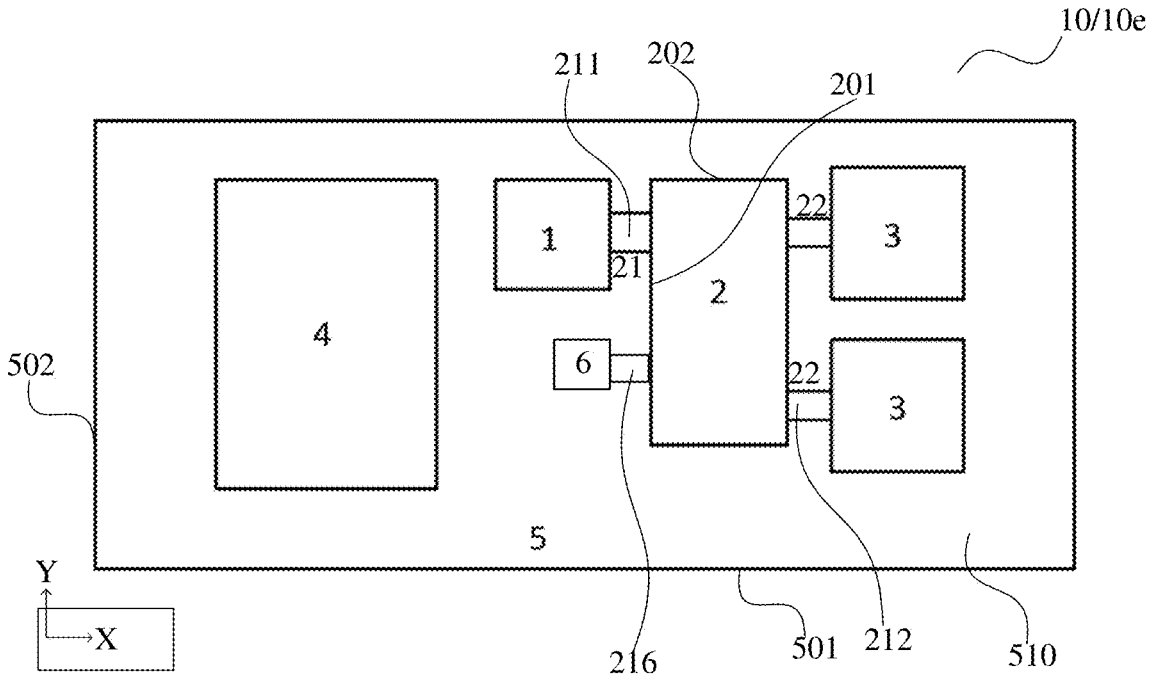

As illustrated in FIG. 2 and FIG. 5, according to the turbine fracturing apparatus provided by the embodiment of the present disclosure, in order to make the turbine engine and the plunger pumps be arranged at different sides of the deceleration device 2, the turbine engine 1 may be arranged at the side of the deceleration device 2 that is opposite to the side of the deceleration device 2 where two plunger pumps 3 are provided. As illustrated in FIG. 2 and FIG. 5, the auxiliary power unit 4, the turbine engine 1, the deceleration device 2, and a plunger pump group consisting of the plurality of plunger pumps 3 may be sequentially arranged in the direction X. The plurality of plunger pumps 3 in the plunger pump group may be sequentially arranged in the direction Y.

As illustrated in FIG. 1-FIG. 6, according to the turbine fracturing apparatus provided by the embodiment of the present disclosure, the deceleration device 2 may include an input shaft 211 and a plurality of output shafts 212. The turbine engine 1 may be connected with the input end 21 of the deceleration device 2 through the input shaft 211, and the plurality of output shafts 212 may be connected with the plurality of output ends 22 of the deceleration device 2. The number of output shafts 212 can be equal to the number of plunger pumps 3, but it is not limited thereto. In some embodiments, the number of output shafts 212 can be greater than the number of plunger pumps 3, and output shafts 212 can be provided for auxiliary components.

Figure 3:
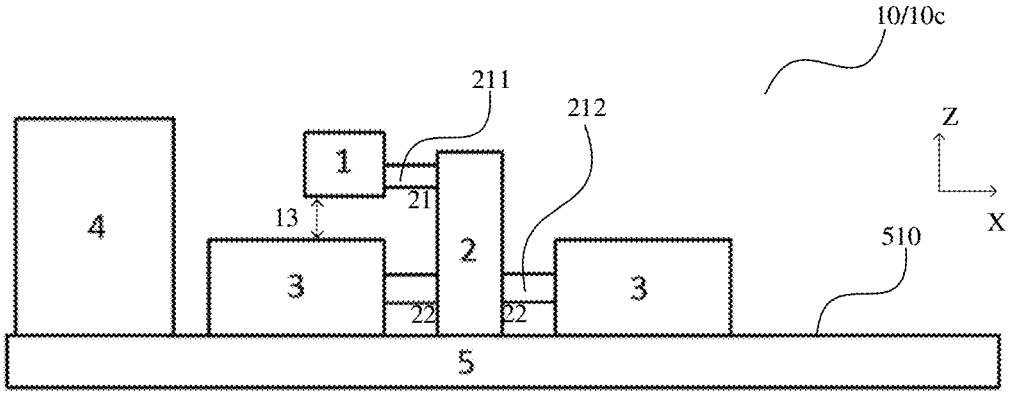
Figure 6:
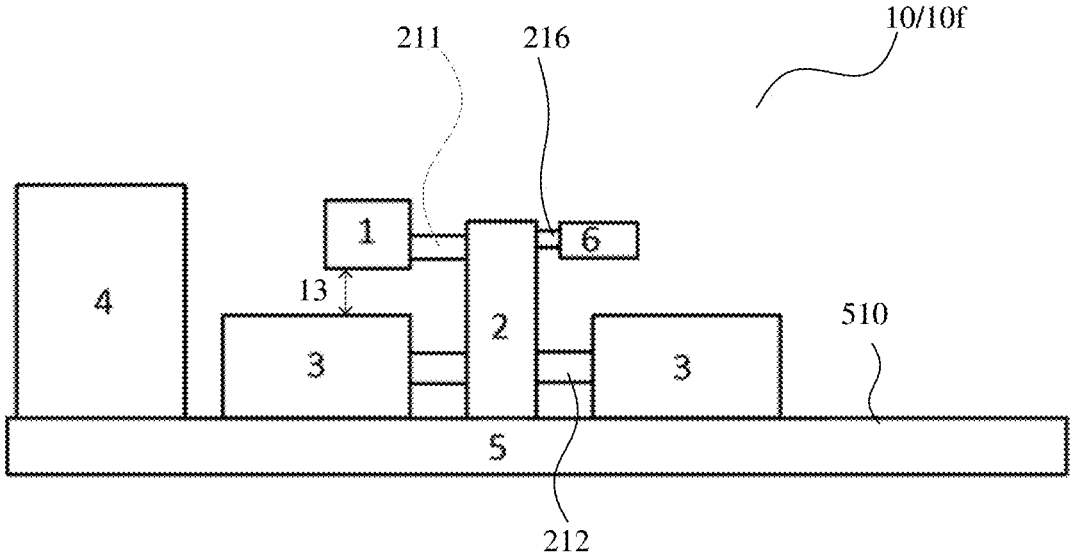

As illustrated in FIG. 3 and FIG. 6, according to the example turbine fracturing apparatus provided by the embodiment of the present disclosure, in order to arrange the plunger pumps dispersedly, two plunger pumps 3 may be arranged at both sides of the deceleration device 2, respectively. As illustrated in FIG. 3 and FIG. 6, two plunger pumps may be sequentially arranged in the direction X. As illustrated in FIG. 3 and FIG. 6, the auxiliary power unit 4, one plunger pump 3, the deceleration device 2, and the other plunger pump 3 may be sequentially arranged in the direction X.

As illustrated in FIG. 3 and FIG. 6, according to the example turbine fracturing apparatus provided by the embodiment of the present disclosure, in order to reduce the size of the base 5 and make the structure of the turbine fracturing apparatus more compact, the turbine engine 1 may be located above one of the two plunger pumps 3. For example, the turbine engine 1 may be located directly above or laterally above one plunger pump 3.

For example, the turbine engine 1 being directly above the plunger pump 3 refers to that the orthographic projection of the turbine engine 1 on the base 5 is within the orthographic projection of the plunger pump 3 on the base 5. For example, the turbine engine 1 being laterally rather than directly above the plunger pump 3 refers to that the orthographic projection of the turbine engine 1 on the base 5 at most partially overlaps or does not entirely overlap with the orthographic projection of the plunger pump 3 on the base 5.

As illustrated in FIG. 3 and FIG. 6, according to the example turbine fracturing apparatus provided by the embodiment of the present disclosure, an interval 13 may be provided between the turbine engine 1 and the plunger pumps 3 in the direction perpendicular to the main surface 510 of the base 5.

For example, in the embodiment of the present disclosure, the direction perpendicular to the main surface 510 of the base 5 is referred to as direction Z, and the directions parallel with the main surface 510 of the base 5 includes direction X and direction Y. The direction X intersects with the direction Y. The embodiment of the present disclosure is described with reference to the case where the direction X is perpendicular to the direction Y, by way of example.

For example, as illustrated in FIG. 1-FIG. 2 and FIG. 4-FIG. 5, the deceleration device 2 may extend in the direction Y, and the auxiliary power unit 4 may extend in the direction Y.

As illustrated in FIG. 3 and FIG. 6, the size of the interval 13 in the direction Z may be less than the size of the auxiliary power unit 4 in the direction Z. As illustrated in FIG. 3 and FIG. 6, in order to facilitate the layout of the auxiliary power unit 4, the turbine engine 1 and the plunger pump 3, the sum of the size of the interval 13 in the direction Z, the size of the turbine engine 1 in the direction Z and the size of the plunger pump 3 in the direction Z may be less than the size of the auxiliary power unit 4 in the direction Z. However, other embodiment of the present disclosure may not be so limited.

As illustrated in FIG. 3 and FIG. 6, according to the example turbine fracturing apparatus provided by the embodiment of the present disclosure, two plunger pumps 3 may be connected with two ends of the same output shaft 212 of the deceleration device 2, so as to simplify the structure of the deceleration device 2.

As illustrated in FIG. 3-FIG. 6, according to the example turbine fracturing apparatus provided by the embodiment of the present disclosure, in order to facilitate the layout of each component, the auxiliary power unit 4 and the deceleration device 2 may be arranged at both sides of the turbine engine 1, respectively.

As illustrated in FIG. 4-FIG. 6, according to the example turbine fracturing apparatus provided by the embodiment of the present disclosure, the auxiliary power unit 4 may include an auxiliary motor 6, and the turbine engine 1 or the deceleration device 2 may be provided with a power take-off port 216 to drive the auxiliary motor. The turbine fracturing apparatus **10*d* in FIG. 4 is illustrated by assuming, as an example, that the power take-off port 216 is provided on the turbine engine 1. The turbine fracturing apparatus 10*e* in FIG. 5 and the turbine fracturing apparatus 10*f* in FIG. 6 are illustrated as another example by assuming that the power take-off port 216 is provided on the deceleration device 2. As illustrated in FIG. 5, the auxiliary motor 6 and the turbine engine 1 may be located at the same side of the deceleration device 2, and may be both located at the side of the deceleration device 2 along the long edge 201 of the deceleration device 2**.

For example, the turbine engine 1 or the deceleration device 2 may be equipped with a power take-off port, which can drive the auxiliary motor to provide power to the auxiliary system and increase the utilization rate of the turbine engine. For example, the auxiliary motor may include a lubricating motor.

As illustrated in FIG. 3 and FIG. 6, considering the width of the vehicle, the turbine engine 1 is placed over the plunger pump 3 to prevent the vehicle from being too wide.

Because of the heavy weight of the turbine fracturing apparatus, in order to make the turbine fracturing apparatus conform to the laws and regulations of various places, it is necessary to lay out or flatten out all components of the turbine fracturing apparatus. Further, because the weight of the plunger pump accounts for a large proportion of the total system weight, the layout position and weight distribution of the plunger pump are particularly important. At the same time, in order to obtain better reliability, besides the layout position of plunger pump, the layout positions of other components can also be correspondingly designed and adjusted. The layouts of the turbine fracturing apparatuses illustrated in FIG. 1-FIG. 6 provided by the embodiments of the present disclosure are beneficial in implementing the decentralized arrangement of plunger pumps to balance the weight distribution of plunger pumps and are beneficial to improving the reliability of the turbine fracturing apparatuses.

By arranging each component of the turbine fracturing apparatus, the structure of the vehicle body is made compact, which helps meeting the requirements for the length and width of the vehicle body. According to the laws and regulations of different regions/countries, the layout may be further adjusted to meet the arrangement requirements for the length and width of the vehicle body.

The weight of the plunger pump 3 is relatively large, so it is necessary to adjust the weight distribution of the plunger pump 3. In some embodiments, it is to be avoided to arrange multiple plunger pumps 3 in the same width direction or the same length direction of the base 5. If it is not allowed to have relatively large weight in the same width direction in some regions, the arrangement of the plunger pumps can be as illustrated in FIG. 1 or FIG. 3. If it is not allowed to have relatively large weight in the same length direction in some regions, the arrangement of the plunger pumps can follow the example manner as illustrated in FIG. 2 or FIG. 5.

The deceleration device 2 may include a gearbox and a gear structure provided in the gearbox. The deceleration device 2 can be configured to adjust the torque or speed, or to adjust the speed reduction ratio. By adjusting the structure of the deceleration device 2, various layouts as illustrated in the figures can be obtained.

As illustrated in FIG. 1 and FIG. 4, the extension directions of the input shaft 211 and the output shaft 212 may be different, which requires the change in directions of power transmission. As illustrated in FIG. 3 and FIG. 6, the output shafts 212 can be a same shaft.

Figure 7:
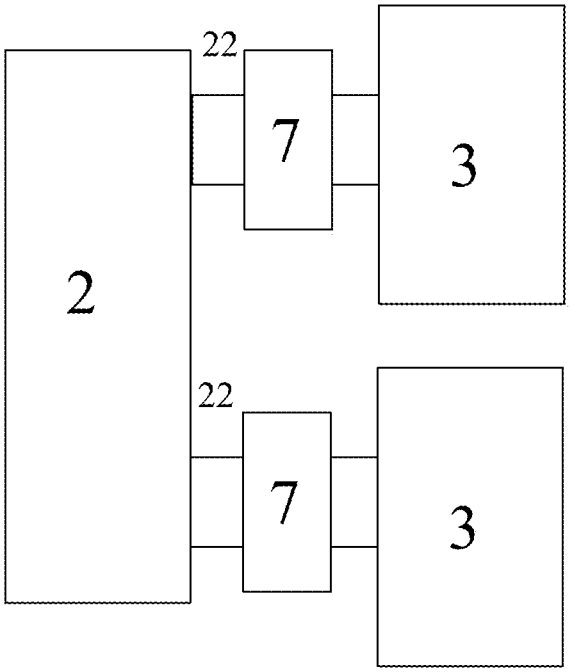
FIG. 7 is a schematic diagram of an example turbine fracturing apparatus including a connecting structure provided by an embodiment of the present disclosure.
Figure 8:
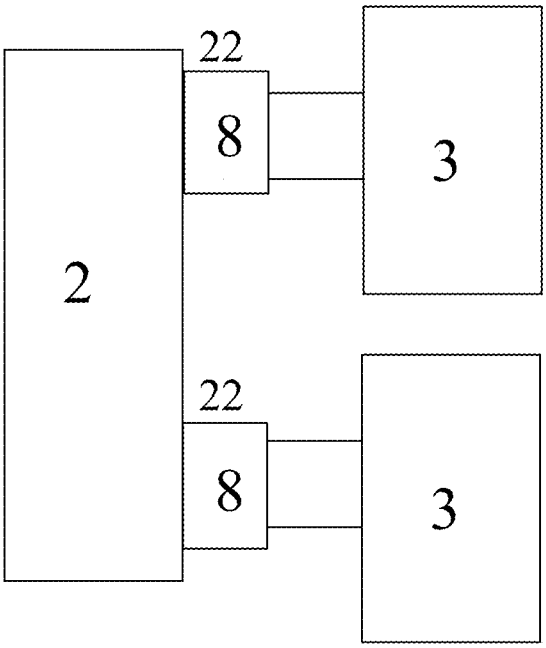
FIG. 8 is a schematic diagram of an example turbine fracturing apparatus including a clutch provided by an embodiment of the present disclosure.
Figure 9:
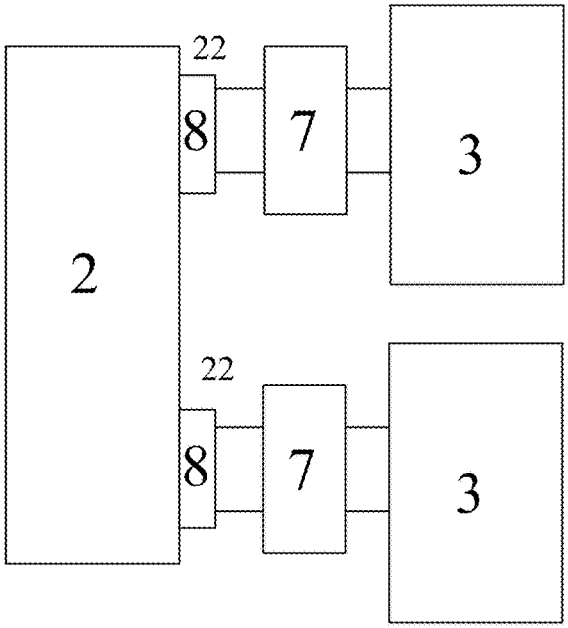
FIG. 9 is a schematic diagram of an example turbine fracturing apparatus including a clutch and a connecting structure provided by an embodiment of the present disclosure.

FIG. 7 is a schematic diagram of a turbine fracturing apparatus including a connecting structure as provided by an embodiment of the present disclosure. FIG. 8 is a schematic diagram of a turbine fracturing apparatus including a clutch provided by an embodiment of the present disclosure. FIG. 9 is a schematic diagram of a turbine fracturing apparatus including a clutch and a connecting structure provided by an embodiment of the present disclosure.

As illustrated in FIG. 7 and FIG. 9, the turbine fracturing apparatus may further include a connecting structure 7, so that the plunger pump can be quickly replaced. The arrangement of the connecting structure 7 is beneficial for achieving rapid disassembly and installation of the plunger pump.

For example, a quick disassembly method of the plunger pump may include: in the control system, firstly, stopping a plunger pump from operating because a connecting structure 7 is arranged at the joint of the plunger pump 3 and the deceleration device 2, the plunger pump 3 and the deceleration device 2 can be quickly connected and disconnected, and the bottom mounting seat of plunger pump 3 may be an assembly structure equipped with a lifting point or forklift hole; then moving the plunger pump from the turbine fracturing apparatus onto a predetermined location via the lifting point or forklift hole; next lifting another plunger pump onto the turbine fracturing apparatus, and further, connecting this plunger pump 3 and the deceleration device 2 together via the connecting structure 7. After that, the plunger pump is started in the control system.

As illustrated in FIG. 8 and FIG. 9, a clutch 8 may be provided at the output end 22 of the deceleration device 2, so as to realize independent control of each output end 22. That is, the plunger pumps 3 connected with the same deceleration device 2 can be independently controlled to be started or stopped. As illustrated in FIG. 8 and FIG. 9, by controlling the clutches 8, one of the two plunger pumps 3 connected with the same deceleration device 2 can be started, and the other of the two plunger pumps 3 connected with the same deceleration device 2 can be stopped. The clutch 8 can control the connection or disconnection of the deceleration device 2 and the plunger pump 3. That is, a plurality of plunger pumps connected with the same deceleration device 2 can be independently controlled.

As illustrated in FIG. 9, the turbine fracturing apparatus may include a connecting structure 7 and a clutch 8. The clutch 8 is closer to the deceleration device 2 than the connecting structure 7. That is, the output end 22 of the deceleration device 2 is successively provided with the clutch 8, the connecting structure 7, and the plunger pump 3.

For example, the control method of the turbine fracturing apparatus provided by the embodiment of the present disclosure may include: the control system independently controls each plunger pump, and when the displacement of one plunger pump decreases, the system can increase the displacement of other plunger pumps to ensure a stable output of the total displacement of the whole apparatus. Therefore, the fracturing apparatus can realize a stable output of the total displacement of the whole apparatus.

FIG. 7 and FIG. 9 are illustrated by as an example by assuming that two plunger pumps 3 are arranged at the same side of the deceleration device 2. In the case where two plunger pumps 3 are provided at both sides of the deceleration device 2, at least one of the connecting structure 7 and the clutch 8 can also be provided. The arrangement positions of the connecting structure 7 and the clutch 8 can be configured according to the various description above.

Figure 10A:
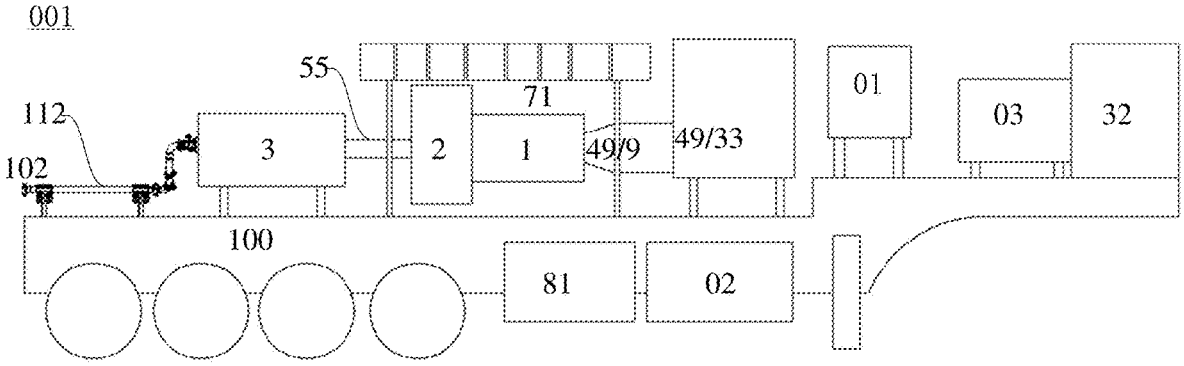
FIG. 10A is a schematic diagram of an example turbine fracturing apparatus.
Figure 10B:
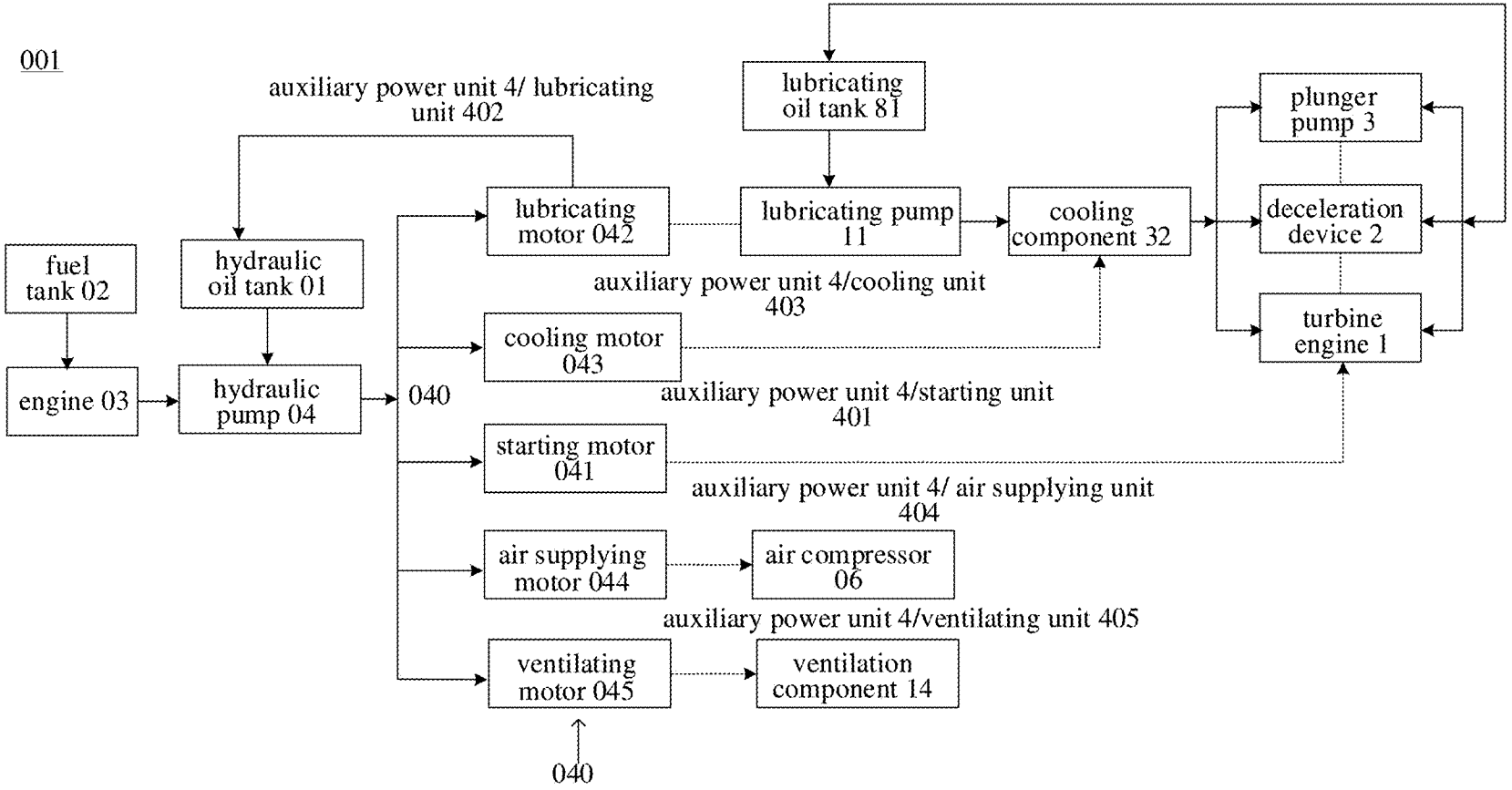
FIG. 10B is a principle diagram of an example turbine fracturing hydraulic system.

FIG. 10A is a schematic diagram of an example turbine fracturing apparatus 001, whereas FIG. 10B is an operation-principle diagram of a turbine fracturing hydraulic system. As illustrated in FIG. 10B, the solid line refers to the hydraulic fluid. The arrow refers to the running direction of the hydraulic fluid. The dashed line refers to the mechanical connection between components. Referring to FIG. 10A and FIG. 10B, the turbine fracturing apparatus 001 may include a vehicle body 100, a hydraulic oil tank 01, a fuel tank 02, an engine 03, a plunger pump 3, a turbine engine 1, a cooling component 32, a muffler 33, a deceleration device 2, and a lubricating oil tank 81, which are arranged on the vehicle body 100. For example, the engine 03 may include a diesel engine, and the fuel tank 02 includes a diesel tank. The lubrication module is not limited to only including lubricating oil. For example, lubricating grease may also be used to lubricate the deceleration device 2. For example, lubricating grease that lubricates the deceleration device 2 can be directly placed in the deceleration device 2.

For example, the turbine fracturing apparatus may be also provided with an air inlet system and an air exhaust system of the turbine engine.

As illustrated in FIG. 10A, the plunger pump 3 may be connected with the turbine engine 1 through the deceleration device 2. A coupling 55 may be provided between the plunger pump 3 and the deceleration device 2. One end of the turbine engine 1 may be connected with the plunger pump 3 through the deceleration device, so as to drive the plunger pump to draw/intake low-pressure fracturing fluid and discharge high-pressure fracturing fluid. In other words, the plunger pump 3 may be configured to pressurize the fracturing fluid to form high-pressure fracturing fluid. As illustrated in FIG. 10A, the other end of the turbine engine 1 may be connected with an air exhaust assembly 49, and the air exhaust assembly 49 may include an exhaust pipe 9 and a muffler 33. The exhaust pipe 9 may be connected with the turbine engine 1 and configured to discharge the exhaust gas. The muffler 33 may be connected with the exhaust pipe 9 and configured to reduce exhaust noise. The fuel tank 02 may supply oil to the engine 03. The engine 03 may be connected with a hydraulic pump 04 (not illustrated in FIG. 10A, referring to FIG. 10B), and the hydraulic tank 01 may be connected with the hydraulic pump 04 (referring to FIG. 10B).

FIG. 10A illustrates an example muffling compartment 71. As illustrated in FIG. 10A, the turbine engine 1 and the deceleration device 2 may be located in the muffling compartment 71, and the muffling compartment 71 may be configured to reduce noise. FIG. 10A further illustrates an example high-pressure manifold 112. For example, the high-pressure manifold 112 may be configured to allow high-pressure fracturing fluid to flow therein. The high-pressure manifold 112 may include a discharge end 102.

As illustrated in FIG. 10B, the hydraulic pump 04 may supply oil to an actuating motor 040 of the turbine fracturing apparatus. The actuating motor 04 may include a starting motor 041, a lubricating motor 042, a cooling motor 043, an air supplying motor 044, and a ventilating motor 045. The lubricating motor 042 may be connected with the lubricating pump 11 to drive the lubricating pump 11 to deliver lubricating oil from the lubricating oil tank 81 to the plunger pump 3, the deceleration device 2, and the turbine engine 1 for lubrication. For example, the vehicle body 100 may include a semi-trailer, but is not limited thereto. The ventilating motor 045 may drive a ventilation component 14. For example, the ventilation component may include a fan, but is not limited thereto.

As illustrated in FIG. 10B, the cooling motor 043 may drive the cooling component 32. The starting motor 041 may be connected with the turbine engine 1 to start the turbine engine 1, and the air supplying motor 044 may drive an air compressor 06. For example, the cooling component 3 may include a fan, but is not limited thereto.

Figure 10C:
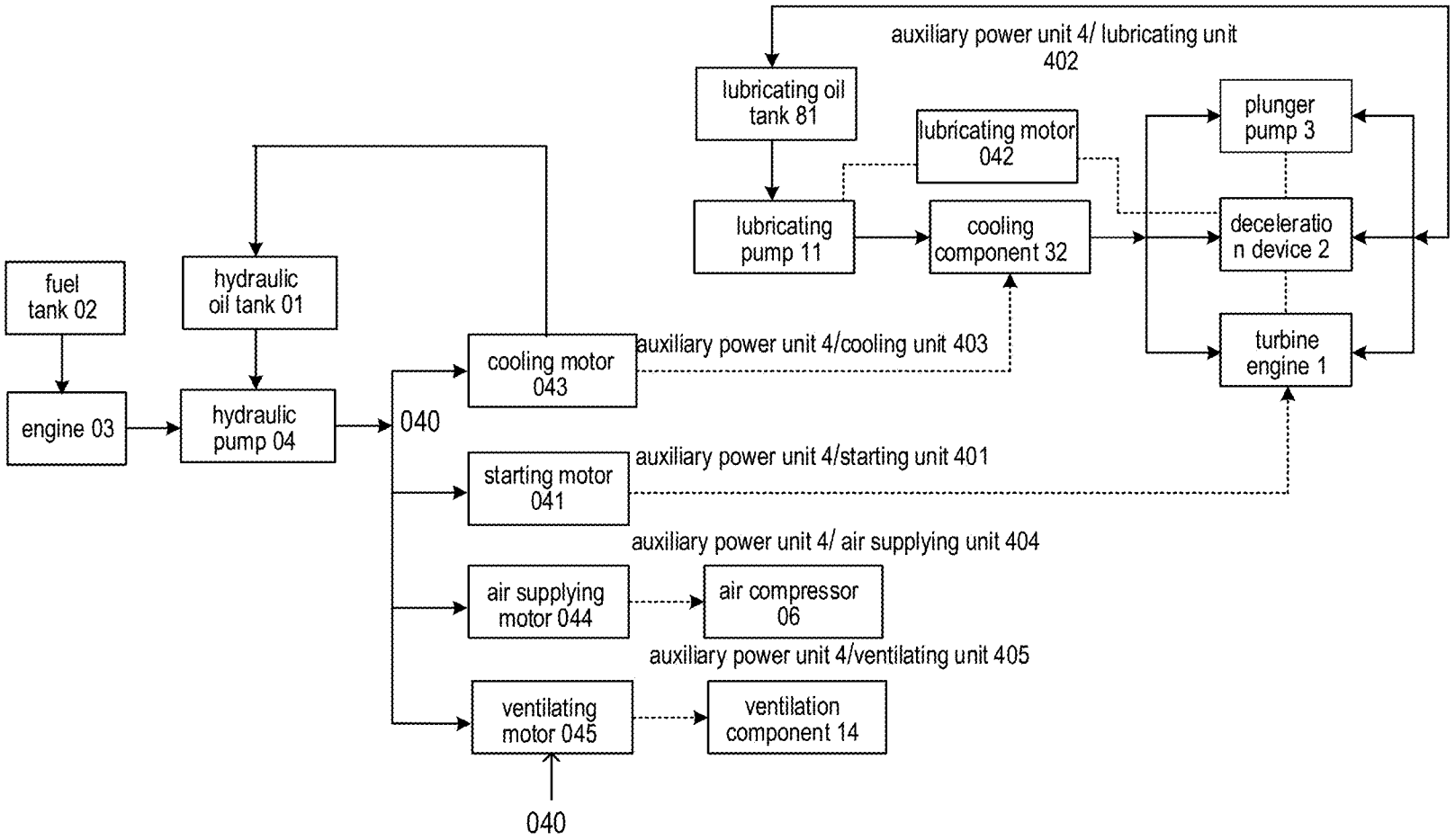
FIG. 10C is a schematic diagram of an example turbine fracturing apparatus provided by an embodiment of the present disclosure.

According to the turbine fracturing apparatus provided by the example embodiment of the present disclosure, the auxiliary power unit 4 may include at least one selected from the group consisting of a starting unit 401, a lubricating unit 402, a cooling unit 403, an air supplying unit 404 and a ventilating unit 405. The auxiliary motor may include at least one of a starting motor 041, a lubricating motor 042, a cooling motor 043, an air supplying motor 044, or a ventilating motor 045. FIG. 10C is a schematic diagram illustrating that the lubricating motor 042 may be driven by the deceleration device 2. In some other embodiments, the lubricating motor 042 can be driven by the turbine engine 1. Accordingly, at least one of the cooling motor 043, the air supplying motor 044, or the ventilating motor 045 can be installed on the turbine engine 1 or the deceleration device 2, so as to be driven by the turbine engine 1 or the deceleration device 2. That is, in the embodiment of the present disclosure, at least one of the lubricating motor 042, the cooling motor 043, the air supplying motor 044, or the ventilating motor 045 can be driven by the turbine engine 1 or the deceleration device 2.

For example, the output end 22 of the deceleration device 2 can also be connected with other auxiliary power components, such as motors, pumps, etc.

For example, the auxiliary power unit 4 may include the lubrication system, the hydraulic system, the air supply system and the heat dissipation system of the whole apparatus. The whole apparatus may be equipped with a noise reduction device to reduce the noise of the apparatus. The noise reduction device may help realize noise reduction for the turbine engine 1, the deceleration device 2, the plunger pump 3 and other noise sources.

The starting motor 041, the lubricating motor 042, the cooling motor 043, the air supplying motor 044, and the ventilating motor 045 in the turbine fracturing apparatus illustrated in FIG. 10A and FIG. 10B may be hydraulically driven. However, at least one of the starting motor 041, the lubricating motor 042, the cooling motor 043, the air supplying motor 044, and the ventilating motor 045 can instead be installed on the turbine engine 1 or the deceleration device 2, and driven by the turbine engine 1 or the deceleration device 2, instead of being hydraulically driven.

For example, the manner of hydraulically driving the auxiliary power unit illustrated in FIG. 10A and FIG. 10B can also be replaced by electric driving. Therefore, alternative to the auxiliary motor being directly driven by the turbine engine 1 or the deceleration device 2, one or more auxiliary motors in the auxiliary power unit can be electrically driven.

The embodiment of the present disclosure is illustrated by implementing a single turbine engine and double pumps. In the case where one turbine engine corresponds to three or more plunger pumps, multiple plunger pumps can be sequentially arranged at the side of the deceleration device 2 along the long edge of the deceleration device 2. Multiple plunger pumps can also be divided into two groups, and these two groups of plunger pumps may be arranged at the two long edges of the deceleration device 2. In other words, plunger pumps of each group may be sequentially arranged at the side of the deceleration device 2 along the long edge of the deceleration device 2.

For example, in some embodiments of the present disclosure, the plurality of plunger pumps can be dispersedly distributed. For example, the plurality of plunger pumps may not be arranged in the same width direction, and/or the plurality of plunger pumps may not be arranged in the same length direction. For example, the direction X mat be the length direction, and the direction Y may be the width direction.

Figure 11:
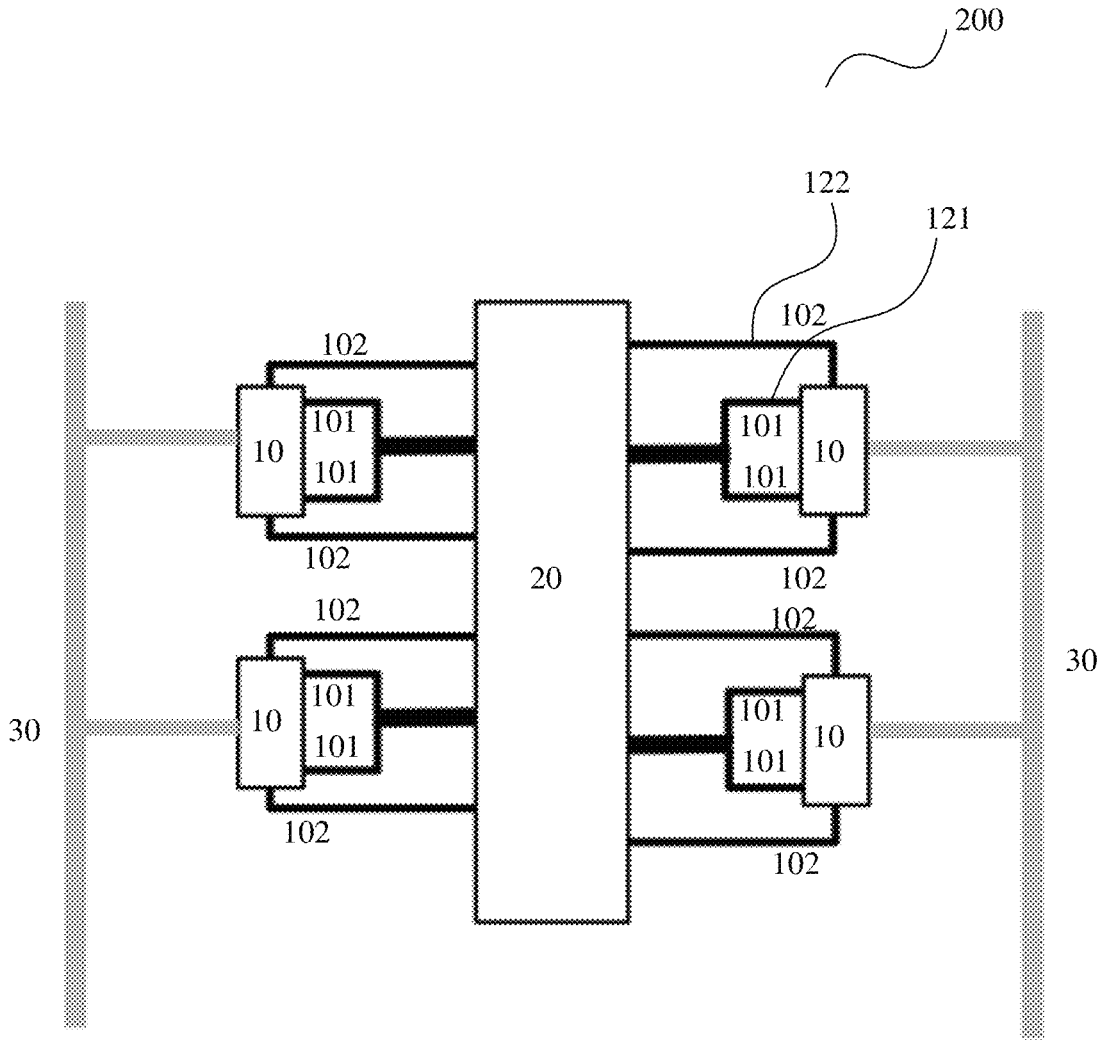
FIG. 11 is a schematic diagram of an example turbine fracturing well site provided by an embodiment of the present disclosure.

The embodiment of the present disclosure further provides a turbine fracturing well site, which includes any one of the turbine fracturing apparatuses mentioned above and belonging to the field of petroleum equipment FIG. 11 is a schematic diagram of an example turbine fracturing well site provided by an embodiment of the present disclosure. As illustrated in FIG. 11, the turbine fracturing well site 200 may further include a manifold skid 20. Each plunger pump 3 may include a discharge end 102. The discharge end 102 of the plunger pump 3 may be configured to discharge high-pressure fluid, and the discharge ends 32 of two plunger pumps 3 may be arranged towards the manifold skid 20.

FIG. 11 further illustrates a suction end 101 of the turbine fracturing apparatus 10. The suction end 101 may be configured to draw/suck/intake low-pressure fluid. The suction end 101 may be the end of the plunger pump that draws/sucks/intakes low-pressure fluid.

As illustrated in FIG. 11, each turbine fracturing apparatus 10 may have two suction ends 101 and two discharge ends 102. That is, each plunger pump has a suction end 101 and a discharge end 102.

A plurality of turbine fracturing apparatuses 10 may form a turbine fracturing set. FIG. 11 is described with reference to the case where the turbine fracturing set includes four turbine fracturing apparatuses 10, by way of example.

FIG. 11 further illustrates a low-pressure manifold 121 and a high-pressure manifold 122. As illustrated in FIG. 11, the low-pressure manifold 121 may include two branches to be connected with the suction ends 101 of two plunger pumps, respectively, in one turbine fracturing apparatus 10.

FIG. 11 illustrates the natural gas pipeline layout of a well site containing the fracturing apparatus provided by the embodiment of the present disclosure. FIG. 11 further illustrates a gas pipeline 30. For example, the gas pipeline 30 is configured to supply gas to the turbine engine 1.

As illustrated in FIG. 11, compared with the common well site, the arrangement manner is changed. The well site layout is more compact.

For example, in some embodiments of the present disclosure, one turbine engine corresponds to two high-pressure output manifolds.

For example, the end of the plunger pump 3 facing away from the deceleration device 2 may be the discharge end.

The turbine fracturing apparatuses illustrated in FIG. 1-FIG. 6 are described with reference to the case where the left side is the front end of the vehicle, the right side is the rear end of the vehicle, and the side surface of the vehicle is between the front end and the rear end, by way of example. In the turbine fracturing apparatus illustrated in FIG. 1 and FIG. 4, the side surface of the vehicle faces the manifold skid 20. In the turbine fracturing apparatus illustrated in FIG. 2 and FIG. 5, the rear end of the vehicle faces the manifold skid 20. In the turbine fracturing apparatus illustrated in FIG. 3 and FIG. 6, the side surface of the vehicle faces the manifold skid 20.

What have been described above are only specific example implementations of the present disclosure, and the protection scope of the present disclosure is not limited thereto. Any changes or substitutions readily derivable by those having ordinary skill in the art according to this disclosure and within the technical scope of the present disclosure should be covered in the protection scope of the present disclosure. The protection scope of the present disclosure should be determined at least based on the protection scope of the claims.

What is claimed is:

1. A turbine fracturing apparatus, comprising:

a turbine engine, configured to provide power;

a speed-reduction device, having an input end and a plurality of output ends, wherein the input end is connected with the turbine engine;

a plurality of plunger pumps, connected with the plurality of output ends, respectively, wherein each of the plurality of plunger pumps is configured to intake a low-pressure fluid and discharge a high-pressure fluid; and an auxiliary power unit, configured to provide auxiliary power to at least one of the turbine engine, the speed-reduction device, or each of the plurality of plunger pumps, wherein the auxiliary power unit, the turbine engine, and the speed-reduction device are sequentially arranged on a transportable platform;

wherein a first plunger pump and a second plunger pump of the plurality of plunger pumps are disposed on two opposite sides of the speed-reduction device and connected to the speed-reduction device via a common rotational driving shaft of the speed-reduction device.

2. The turbine fracturing apparatus according to claim 1, wherein:

the speed-reduction device comprises an input shaft and a plurality of output shafts;

the turbine engine is connected with the input end of the speed-reduction device through the input shaft; and the plurality of output shafts are correspondingly connected with the plurality of output ends of the speed-reduction device.

3. The turbine fracturing apparatus according to claim 1, wherein the auxiliary power unit is arranged on one side of the turbine engine and the speed-reduction device is arranged on another side of the turbine engine.

4. The turbine fracturing apparatus according to claim 3, wherein:

the auxiliary power unit comprises an auxiliary motor; and the turbine engine or the speed-reduction device is provided with a power take-off port to drive the auxiliary motor.

5. The turbine fracturing apparatus according to claim 4, wherein:

the auxiliary power unit further comprises at least one of a lubricating unit, a cooling unit, an air supplying unit, or a ventilating unit; and the auxiliary motor comprises at least one of a lubricating motor, a cooling motor, an air supplying motor, or a ventilating motor.

6. The turbine fracturing apparatus according to claim 1, further comprising at least one clutch, wherein one of the at least one clutch is provided between each of the plurality of plunger pumps and the speed-reduction device.

7. The turbine fracturing apparatus according to claim 6, further comprising at least one connecting structure, wherein each of the plurality of plunger pumps is connected with the speed-reduction device through one of the at least one connecting structure, and the at least one clutch is closer to the speed-reduction device than the at least one connecting structure.

8. The turbine fracturing apparatus according to claim 1, wherein:

the transportable platform comprises a long edge and a short edge; and the turbine engine and the speed-reduction device are sequentially arranged along an extending direction of the long edge of the transportable platform.

9. The turbine fracturing apparatus according to claim 1, wherein an interval is provided between the turbine engine and the plurality of plunger pumps in a direction perpendicular to a main surface of the transportable platform.

10. A turbine fracturing well site, comprising the turbine fracturing apparatus according to claim 1.

11. The turbine fracturing well site according to claim 10, further comprising a manifold skid, wherein:

each of the plurality of plunger pumps comprises a discharge end;

the discharge end of each of the plurality of plunger pumps is configured to discharge the high-pressure fluid; and the discharge ends of the plurality of plunger pumps are arranged towards the manifold skid.

* * * * *